US011841129B2

(12) United States Patent
Van Bommel et al.

(10) Patent No.: US 11,841,129 B2
(45) Date of Patent: Dec. 12, 2023

(54) FLEXIBLE LIGHT EMITTING DIODE FILAMENT COMPRISING AT LEAST ONE ALIGNMENT MEMBER

(71) Applicant: SIGNIFY HOLDING B.V., Eindhoven (NL)

(72) Inventors: Ties Van Bommel, Horst (NL); Rifat Ata Mustafa Hikmet, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/761,465

(22) PCT Filed: Sep. 14, 2020

(86) PCT No.: PCT/EP2020/075606
§ 371 (c)(1),
(2) Date: Mar. 17, 2022

(87) PCT Pub. No.: WO2021/052899
PCT Pub. Date: Mar. 25, 2021

(65) Prior Publication Data

US 2022/0341570 A1 Oct. 27, 2022

(30) Foreign Application Priority Data

Sep. 19, 2019 (EP) ..... 19198394

(51) Int. Cl.
*F21V 19/00* (2006.01)
*F21K 9/232* (2016.01)
*F21Y 115/10* (2016.01)

(52) U.S. Cl.
CPC ..... *F21V 19/002* (2013.01); *F21K 9/232* (2016.08); *F21Y 2115/10* (2016.08)

(58) Field of Classification Search
CPC ..... F21V 19/002; F21V 19/004; F21K 9/232; F21Y 2115/10; F21Y 2103/30; F21Y 2107/70
See application file for complete search history.

(56) References Cited

U.S. PATENT DOCUMENTS

| | | | | |
|---|---|---|---|---|
| 9,464,800 | B2 | 10/2016 | Kim et al. | |
| 2017/0130906 | A1* | 5/2017 | Jiang | H01L 33/62 |
| 2017/0241598 | A1 | 8/2017 | Jiang et al. | |
| 2018/0112831 | A1* | 4/2018 | Huang | H01L 25/0753 |
| 2019/0191535 | A1 | 6/2019 | Hikmet et al. | |

FOREIGN PATENT DOCUMENTS

| | | | | |
|---|---|---|---|---|
| CN | 105371243 A | | 3/2016 | |
| CN | 106764522 A | | 5/2017 | |
| CN | 206958642 U | * | 2/2018 | F21K 9/232 |
| CN | 208579174 U | | 3/2019 | |

(Continued)

*Primary Examiner* — Tracie Y Green

(57) ABSTRACT

The present disclosure relates to a light-emitting diode, LED, filament (100) including a filament core. The filament core comprises a flexible elongated carrier (102) having a first side, a plurality of LEDs (104) arranged on the first side, and an encapsulant (106) embedding at least said plurality of LEDs and at least a portion of the carrier. At least one alignment member (108) protrudes from the filament core at an angle from an elongation of the filament core.

10 Claims, 4 Drawing Sheets

(56) References Cited

FOREIGN PATENT DOCUMENTS

| | | | | |
|---|---|---|---|---|
| DE | 102016105211 | A1 | | 9/2017 |
| EP | 3316300 | A1 | | 5/2018 |
| WO | 2017186150 | A1 | | 11/2017 |
| WO | 2019015763 | A1 | | 1/2019 |
| WO | WO-2019015763 | A1 | * | 1/2019 |
| WO | 2019201642 | A1 | | 10/2019 |

* cited by examiner

FLEXIBLE LIGHT EMITTING DIODE FILAMENT COMPRISING AT LEAST ONE ALIGNMENT MEMBER

CROSS-REFERENCE TO PRIOR APPLICATIONS

This application is the U.S. National Phase application under 35 U.S.C. § 371 of International Application No. PCT/EP2020/075606, filed on Sep. 14, 2020, which claims the benefit of European Patent Application No. 19198394.9, filed on Sep. 19, 2019. These applications are hereby incorporated by reference herein.

TECHNICAL FIELD

The present disclosure relates generally to the field of solid state lighting. Specifically, it relates to a flexible light-emitting diode filament comprising at least one alignment member.

BACKGROUND

Incandescent lamps are rapidly being replaced by light-emitting diode (LED) based lighting solutions. It is, however, desired by users to have retrofit lamps which have the look of an incandescent bulb.

To emulate the look of an incandescent light bulb filament, flexible LED filaments have been developed. However, flexible LED filaments typically emit most of the light from a single side. It is therefore desired to improve the light distribution of LED filament lamps.

SUMMARY

It is therefore an object of the present invention to overcome some of the above mentioned drawbacks, and to provide an improved LED filament.

This and other objectives are achieved by means of a LED filament as defined in the appended independent claim. Other embodiments are defined by the dependent claims. According to an aspect of the present disclosure, a light-emitting diode (LED) filament is provided. The LED filament includes an elongated, rounded filament core, which comprises a flexible elongated carrier, a plurality of LEDs arranged on a first side of the carrier, and an encapsulant which embeds at least the plurality of LEDs and at least a portion of the carrier. Further, at least one alignment member protrudes from the filament core at an angle from an elongation of the filament core.

Specifically, an angle is formed between the direction of protrusion of the alignment member and the direction of elongation of the filament core. In other words, the alignment member extends in a direction at an angle from a longitudinal axis of the LED filament. The alignment member may protrude in a direction substantially perpendicular to the elongation of the LED filament and/or a longitudinal axis of the LED filament.

A LED filament comprising an alignment member protruding from a rounded core (having a smooth and curved surface) may facilitate arrangement (positioning/alignment) of the LED filament within a lamp. The alignment member of the LED filament may for example act as a handle or grip for arrangement means to hold onto. Further, the alignment member may provide that the rotation or direction of the LED filament may be controlled. For example, with the alignment member, the LED filament may be turned/directed so that the first side of the carrier, on which the LEDs are arranged, faces a desired direction. As many conventional LED filaments have a circular core/body, turning or directing the conventional LED filament may be difficult.

Specifically, at least one alignment member may be arranged at a distance from the outer ends of the LED filament. The alignment member may thus provide a means for shaping, aligning and/or positioning an intermediate portion of the LED filament, the intermediate portion being located between the outer ends of the LED filament. According to some embodiments, the at least one alignment member may be formed by an extension of the carrier, through the encapsulant.

The carrier may extend across the entire width or diameter of the LED filament such that the portion of the carrier which does not form the alignment member is embedded between a first encapsulant which may cover the first side, and a second encapsulant which may cover a second side of the carrier opposite to the first side. Alternatively, the carrier may extend (from one side of the LED filament) across only part of the width or diameter of the LED filament. For example, the carrier may extend across 60-90% of the width or diameter of the LED filament.

For example, a LED filament may have a diameter in the range 1-5 mm. Specifically, a LED filament may have a diameter in the range 2-4 mm. More specifically, a LED filament may have a diameter of 3 mm.

According to some embodiments, the at least one alignment member may be formed by a protrusion of the encapsulant.

In the two preceding embodiments, the entire carrier may be embedded in the encapsulant.

According to some embodiments, the at least one alignment member may be formed by an alignment element which may be partly inserted into the encapsulant.

In such embodiments, the entire carrier may be embedded in the encapsulant. The alignment element may be inserted to a specific depth (insertion depth) into the encapsulant. For example, the insertion depth may be 0.1-0.5 times the diameter of the LED filament.

According to some embodiments, a portion of the alignment member not being covered by the encapsulant may be electrically insulated. In other words, portions of the alignment member which are not covered by the encapsulant may be without electrical connections or tracks. Separating the alignment member from the electrically conductive portions of the LED filament may improve safety and stability. For example, the alignment member may be formed from a material other than metal, such as e.g. glass, sapphire, quartz or plastic.

According to some embodiments, the at least one alignment member may extend continuously along an elongation of the LED filament.

For example, the alignment member may extend along substantially the entire length of the LED filament. Alternatively, or additionally, the alignment member may extend along substantially the entire length of the encapsulant.

For example, a flexible LED filament may have a length in the range 7-30 cm. Specifically, a flexible LED filament may have a length in the range 8-25 cm. More specifically, a flexible LED filament may have a length in the range 9-20 cm.

Although this disclosure relates specifically to flexible LED filaments, it is appreciated that rigid LED filaments may also comprise alignment members. Such rigid LED filaments may for example have a length in the range 2-7 cm. Specifically, they may have a length in the range 2.5-6 cm.

More specifically, rigid LED filaments may have a length in the range 3-5 cm, such as 4 cm.

According to some embodiments, the at least one alignment member may extend in segments arranged at particular positions along an elongation of the LED filament.

For example, the length of a segment may be in the range 0.05-0.2 times the length of the LED filament.

For example, a flexible LED filament may comprise at least 5 alignment member segments. Specifically, a flexible LED filament may comprise at least 8 alignment member segments. More specifically, a flexible LED filament may comprise at least 10 alignment member segments.

A rigid filament comprising such alignment member segments may, for example, comprise at least two alignment member segments.

According to some embodiments, the segments of the at least one alignment member may be arranged at regular intervals along the elongation of the LED filament. In other words, the distance between two successive segments may be at least substantially equal for each pair of successive segments.

According to some embodiments, a length of protrusion of the at least one alignment member from the filament core may be in the range 1-10 mm.

Specifically, the length of protrusion may be in the range 2-8 mm. More specifically, the length of protrusion may be in the range 3-5 mm.

Alternatively, the length of protrusion may be defined relative to a LED filament diameter. For example, the length of protrusion may be 0.1-3 times as long as the LED filament diameter. Specifically, the length of protrusion may be 0.3-2 times as long as the LED filament diameter. More specifically, the length of protrusion may be 0.5-1 times as long as the LED filament diameter.

A thickness of the alignment member may be smaller than a thickness of the LED filament. Specifically, a thickness of the alignment member may be smaller than a diameter of the LED filament.

According to some embodiments, the alignment member may comprise an end portion which may be wider than a width of a portion of the alignment member which is adjacent to the filament core.

A wider end portion may facilitate arrangement of a LED filament, as the wider end portion may provide that the LED filament may be more securely fastened.

For example, the alignment member may become successively wider towards the end portion, such that it forms a wedge shape. Alternatively, the end portion may become wider without tapering, such as in one or more steps.

Alternatively, the alignment member may comprise at least one groove or indentation, which may facilitate fastening or holding of the alignment member by e.g. a clamp. Such embodiments may also provide that the LED filament may be more securely fastened.

According to some embodiments, at least a portion of the filament core may have a cylindrical shape. Further, the at least one alignment member may protrude radially from the cylindrically shaped portion.

According to some embodiments, the encapsulation may embed (or cover) the first side of the carrier. Further, the encapsulation may embed (or cover) a second side of the carrier which may be opposite to the first side.

The encapsulation may further comprise luminescent material and/or scattering material.

The at least one alignment member may be rigid. Alternatively, the at least one alignment member may be flexible. The at least one alignment member may comprise a reflective material. Alternatively, the at least one alignment member may comprise a translucent or transparent material. The at least one alignment member may for example comprise any of the following materials: glass, sapphire, quartz or plastic.

According to another aspect, a LED filament arrangement may be provided. The LED filament arrangement may comprise a LED filament as described above with reference to any of the preceding embodiments. The LED filament arrangement may further comprise at least one holding unit. The holding unit may comprise a holding portion which is adapted to mate with the alignment member of the LED filament. The holding unit may further be arranged to hold the LED filament by insertion of the alignment member of the LED filament into the holding portion of the holding unit.

The holding unit may be adapted to firmly secure the LED filament in place. For example, the holding unit may comprise an arrangement portion. Such an arrangement portion may be adapted for connecting with e.g. a base of a lighting device, or with an arrangement structure (such as a center pole) within a lighting device.

According to some embodiments, the holding unit may comprise a clamp. The clamp may be arranged to clamp the at least one alignment member. A clamp may facilitate secure fastening of the LED filament.

According to some embodiments, the holding unit may further comprise a cavity in which a portion of the LED filament may be arranged such that the holding unit may surround the portion of the LED filament. The holding unit surrounding the portion of the LED filament may facilitate secure fastening of the LED filament.

According to another aspect, a lighting device may be provided. The lighting device may comprise a LED filament arrangement as described above in relation to any of the preceding embodiments. The lighting device may further comprise an at least partially light-transmissive envelope, which may at least partially envelop the LED filament arrangement. The lighting device may further comprise a base on which the envelope may be mounted. A position of the at least one holding unit may determine a position of the LED filament within the envelope.

For example, the at least one holding unit may comprise an arrangement portion. The arrangement portion may be connected with the base of the lighting device. Alternatively, the arrangement portion may be connected with, or form part of an arrangement structure of the lighting device. Further, the at least one alignment member of the LED filament may allow for the LED filament to be arranged (directed/aligned) to provide a desired light distribution. For example, the alignment member may provide that the LED filament is aligned such that the first side of the carrier, on which the plurality of LEDs is arranged, faces the exterior or envelope of the lighting device.

The LED filament may for example be arranged to form a spiral shape, or a crown shape.

It is noted that other embodiments using all possible combinations of features recited in the above described embodiments may be envisaged. Thus, the present disclosure also relates to all possible combinations of features mentioned herein.

BRIEF DESCRIPTION OF THE DRAWINGS

Exemplifying embodiments will now be described in more detail with reference to the following appended drawings.

As illustrated in the figures, the sizes of the elements and regions may be exaggerated for illustrative purposes and, thus, are provided to illustrate the general structures of the embodiments. Like reference numerals refer to like elements throughout.

DETAILED DESCRIPTION

Exemplifying embodiments will now be described more fully hereinafter with reference to the accompanying drawings in which currently preferred embodiments are shown. The invention may, however, be embodied in many different forms and should not be construed as limited to the embodiments set forth herein; rather, these embodiments are provided for thoroughness and completeness, and fully convey the scope of the invention to the skilled person.

Figure 1:
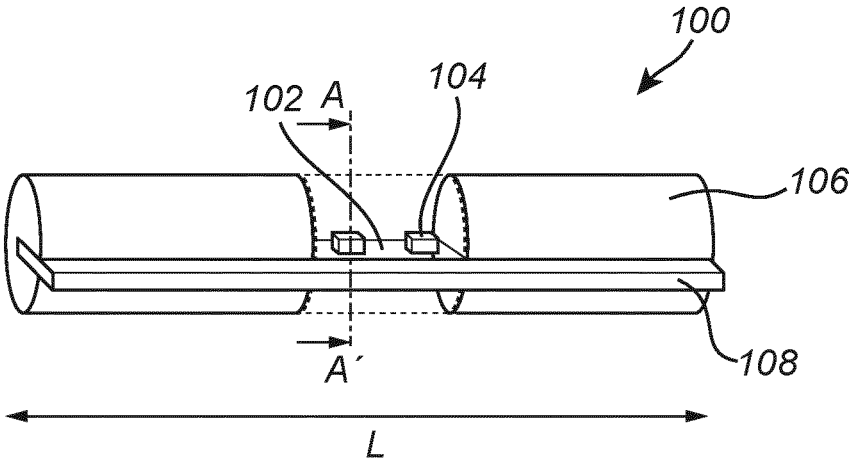
FIG. 1 is an isometric illustration of a LED filament in accordance with some embodiments.
Figure 1A:
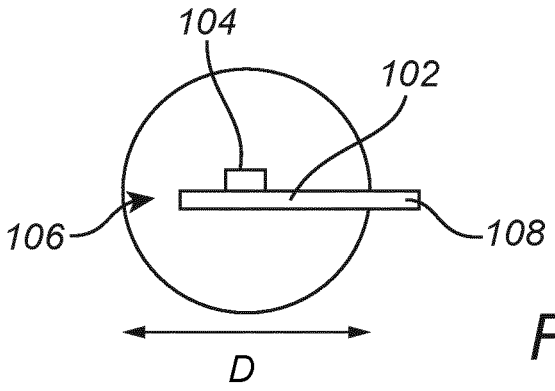
FIG. 1*a* is a cross-sectional view of the same LED filament.

With reference to FIGS. 1 and 1*a*, a LED filament 100 in accordance with some embodiments will be described. FIG. 1 shows an isometric view of the LED filament 100, while FIG. 1*a* shows a cross-sectional view of the same LED filament, wherein the cross section is taken along the line A-A' as shown in FIG. 1.

The LED filament 100 comprises a flexible carrier 102. The carrier 102 may be light-transmissive, such as transparent. For example, the carrier 102 may be a substrate. Such a substrate may comprise a polymer or a metal, for example in the shape of a film or a foil.

The carrier 102 has a first side on which a plurality of LEDs 104 is arranged. In the present embodiment, the LEDs 104 are arranged in a linear array on the first side of the carrier 102. It will, however, be appreciated that the LEDs may be arranged in a different configuration and may be located on one or more sides of the carrier.

The LEDs 104 are adapted to emit light. For example, the LEDs 104 may be adapted to emit light in the ultraviolet range (UV LEDs). The LEDs 104 may alternatively, or additionally, be adapted to emit light in the blue range (blue LEDs). Alternatively, the LEDs 104 may be red-green-blue, RGB, LEDs which use a combination of red, green, and blue LEDs to form light of a specific color.

The LED filament 100 further comprises an encapsulant 106. The encapsulant 106 may for example comprise a silicone material. In the present embodiment, the encapsulant covers the first side of the carrier 102, as well as a second side of the carrier, opposite to the first side. In other words, the encapsulant embeds the LEDs 104, and embeds a portion of the carrier 102. Thus, the LED filament core, in this embodiment defined by the encapsulant 106, has a round cross section. Specifically, the core of the LED filament 100 has an elongated shape with a rounded cross-section. In other words, the cross-section of the LED filament core has no sharp edges or corners.

In embodiments comprising UV and/or blue LEDs especially, the encapsulant 106 may comprise luminescent material. The luminescent material may be a phosphor, such as an inorganic phosphor, and/or quantum dots or rods. The luminescent material may absorb light emitted by the LEDs, and emit light at different wavelengths. In embodiments in which some light is absorbed and re-emitted by luminescent material, the light emitted by the LED filament may be a combination of light emitted by the LEDs and light absorbed and re-emitted by the luminescent material. Such a combination of light may for example have a white appearance.

Embodiments using RGB LEDs may also comprise luminescent material in the encapsulant. Further, the encapsulant 106 may comprise light-scattering particles.

Moreover, the LED filament 100 is equipped with an alignment member 108 protruding from the core of the LED filament 100. In the present embodiment, the LED filament 100 has a substantially cylindrical shape. The alignment member 108 is formed by an extension of the carrier 102 through the encapsulant 106, such that the alignment member 108 extends radially from the encapsulant 106.

The LED filament 100 has a length L along an elongation of the LED filament 100. The length L of the LED filament may be in the range 7-30 cm. For example, the length L of the LED filament 100 may be in the range 8-25 cm. More specifically, the length L of the LED filament 100 may be in the range 9-20 cm. In the present embodiment, the alignment member 108 extends continuously along the entire length L (elongation) of the LED filament 100.

The LED filament further has a diameter D. For example, the diameter D of the LED filament 100 may be in the range 1-5 mm. Specifically, the diameter D of the LED filament 100 may be in the range 2-4 mm. More specifically, the diameter D of the LED filament 100 may be substantially equal to 3 mm.

A thickness of the alignment member 108 is smaller than the diameter D.

It will be appreciated that, in general, a LED filament may be configured to provide LED filament light and may comprise a plurality of light emitting diodes (LEDs) arranged in a linear array. Preferably, the LED filament may have a length L and a width W, wherein L>5 W. The LED filament may be arranged in a straight configuration or in a non-straight configuration such as for example a curved configuration, a 2D/3D spiral or a helix. Preferably, the LEDs may be arranged on an elongated carrier like for instance a substrate, that may be flexible (e.g. made of a polymer or metal e.g. a film or foil).

In case the carrier comprises a first major surface and an opposite second major surface, the LEDs may be arranged on at least one of these surfaces. The carrier may be reflective or light-transmissive, such as translucent and preferably transparent.

The LED filament may comprise an encapsulant at least partly covering at least part of the plurality of LEDs. The encapsulant may also at least partly cover at least one of the first major or second major surface. The encapsulant may be a polymer material which may be flexible such as for example a silicone. Further, the LEDs may be arranged for emitting LED light e.g. of different colors or spectrums. The encapsulant may comprise a luminescent material that may be configured to at least partly convert LED light into converted light. Thus, the LED filament light may comprise a combination of LED light and converted light. The luminescent material may be a phosphor such as an inorganic phosphor and/or quantum dots or rods.

Figure 2:
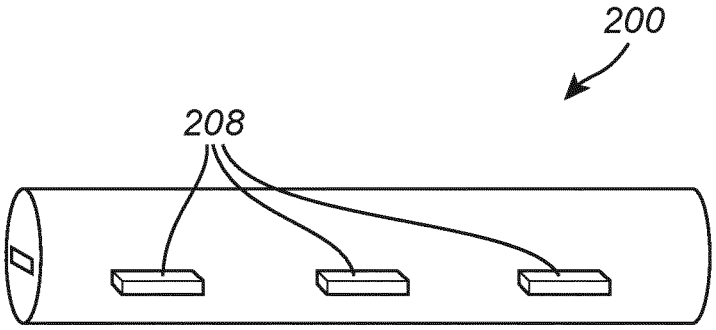
FIG. 2 is an isometric illustration of a LED filament in accordance with some embodiments.

With reference to FIG. 2, a LED filament 200 in accordance with some embodiments will be described. FIG. 2 shows an isometric view of a LED filament 200. The LED filament 200 may be equivalent to the LED filament 100 described with reference to FIGS. 1 and 1*a*, except that the alignment member 208 extends in segments along the elongation of the LED filament 200. The present figure shows three such segments 208 arranged at regular intervals along the elongation of the LED filament 200. However, it will be appreciated that in other embodiments the at least one alignment member may extend in fewer or more segments arranged at particular positions along the elongation of the LED filament.

The alignment member segments on a LED filament may be of (substantially) equal length, or different lengths. For example, a segment may be 0.05-0.2 times the length of the LED filament.

Figure 3:
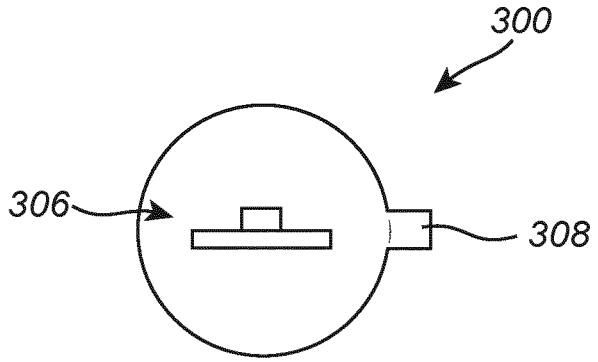
FIG. 3 is a cross-sectional illustration of a LED filament in accordance with some embodiments.

With reference to FIG. 3, a LED filament 300 in accordance with some embodiments will be described. FIG. 3 is a cross-sectional view of a LED filament 300. The LED filament 300 may be equivalent to the LED filament 100 described with reference to FIGS. 1 and 1*a*, or to the LED filament 200 described with reference to FIG. 2, except that the alignment member 308 is formed by a protrusion of the encapsulant 306. In other words, while in the embodiment of e.g. FIGS. 1 and 1*a*, the alignment member is formed by an extension of the carrier 102 through the encapsulant 106, the alignment member 308 is, in the present embodiment, formed by a protrusion of the encapsulant itself. In this embodiment, the carrier is entirely embedded in the encapsulant 306. The encapsulant 306 forms a cylindrical body, corresponding to the core of the LED filament 300, within which the carrier is embedded, and from which the alignment member 308 protrudes.

Figure 4:
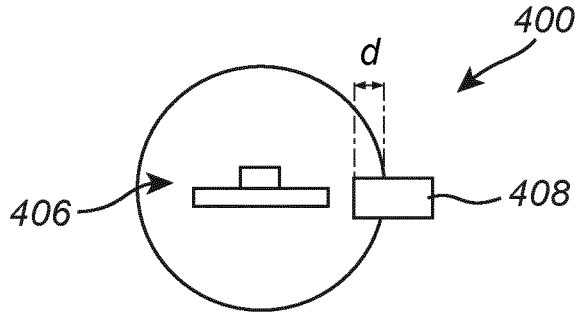
FIG. 4 is a cross-sectional illustration of a LED filament in accordance with some embodiments.

With reference to FIG. 4, a LED filament 400 in accordance with some embodiments will be described. FIG. 4 is a cross-sectional view of a LED filament 400. The LED filament 400 may be equivalent to LED filament 100 described with reference to FIGS. 1 and 1*a*, or to LED filament 200 described with reference to FIG. 2, except that the alignment member 408 is formed by an alignment element partly inserted into the encapsulant 406. The alignment element 408 is inserted an insertion depth d (or distance) into the encapsulant 406. Thus, in the present embodiment, like in the embodiment described with reference to FIG. 3, the carrier is entirely embedded in the encapsulant 406. In other words, the encapsulant 406 forms a cylindrical body which defines the core of the LED filament 400. The carrier (and LEDs) is embedded within the encapsulant 406. The alignment element, forming the alignment member 408, is partly inserted into the encapsulant 406. In the present embodiment, the alignment element is inserted into the encapsulant at a level with the carrier, without being in contact with the carrier.

Figure 5:
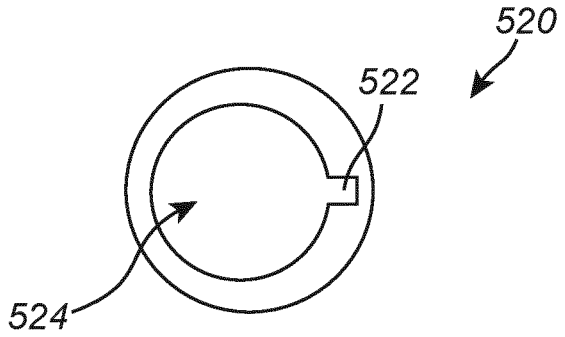
FIG. 5 is a cross-sectional illustration of a holding unit in accordance with some embodiments.

With reference to FIG. 5, a holding unit 520 in accordance with some embodiments will be described. FIG. 5 is a cross-sectional view of the holding unit 520. The holding unit 520 comprises a holding portion 522 and a cavity 524. In the present embodiment, the holding unit 520 forms a tubular shape. In other words, the holding unit 520 has a cylindrical shape, and a cylindrical cavity 524 extending through the holding unit 520. The holding portion 522 forms a notch/indent in the sidewall of the cavity 524. The holding portion 522 is adapted to mate with an alignment member of a LED filament, such as the LED filaments 100-400 described with reference to any of the preceding figures. For example, the shape of the holding portion may be adapted to the shape of the alignment member 108-408 (see FIGS. 1-4) of a LED filament.

The cavity 524 is adapted for receiving the LED filament, such that the holding unit 520 surrounds a portion of the LED filament. Specifically, the size and shape of the cavity 524 (e.g. the inner diameter of a cylindrical cavity) may be adapted to the perimeter of the LED filament (or circumference of a cylindrical LED filament).

For instance, the inner diameter of the holding unit 520 may be 0.8 to 1.5 times the diameter of the LED filament. Specifically, the inner diameter of the holding unit 520 may be 0.9 to 1.3 times the diameter of the LED filament. More specifically, the inner diameter of the holding unit 520 may be 1 to 1.2 times the diameter of the LED filament.

Figure 6:
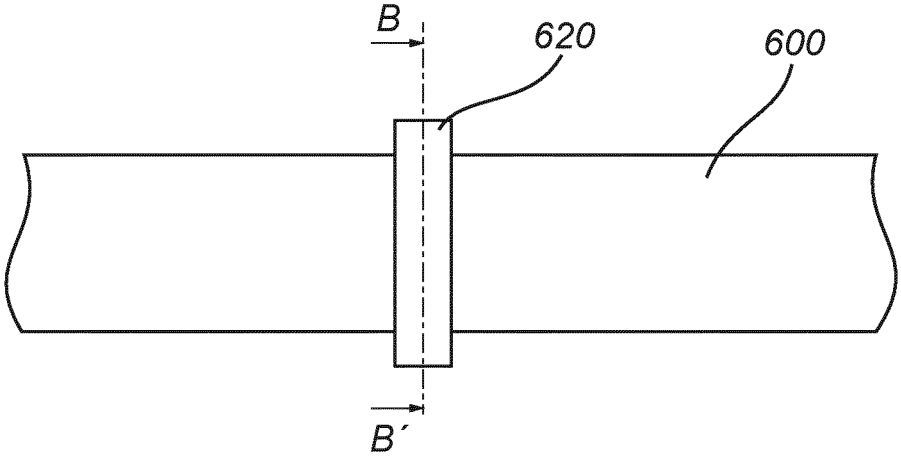
FIG. 6 is an illustration of a part of a LED filament arrangement in accordance with some embodiments.
Figure 6A:
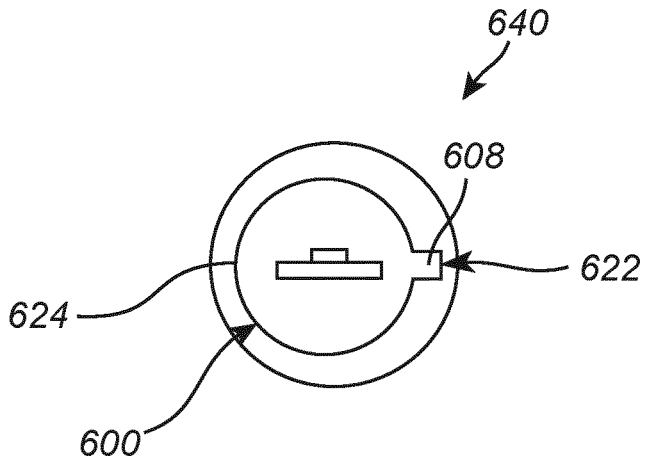
FIG. 6A is a cross-sectional illustration of the same LED filament arrangement.

With reference to FIGS. 6 and 6A, a LED filament arrangement 640 in accordance with some embodiments will be described. FIG. 6 is a side view of a portion of a LED filament arrangement 640 comprising a LED filament 600 and a holding unit 620. FIG. 6A is a cross-sectional view of the LED filament arrangement 640, taken along the line B-B' shown in FIG. 6. A portion of the LED filament 600, from which an alignment member 608 protrudes, is arranged within the cavity 624 of the holding unit 620. The alignment member 608 is inserted into the holding portion 622 of the holding unit. The size and shape of the cavity is adapted to the perimeter of the LED filament 600. The holding portion 622 is adapted to mate with the alignment member 608. Thus, the LED filament 600 and the alignment member 608 are securely fastened within the cavity 624 and the holding portion 622, respectively, of the holding unit 620.

As the alignment portion 608 is securely fastened in the holding portion 622, the alignment/direction of the LED filament 600 may be controlled by turning the holding unit 620. Thus, the light distribution of the LED filament arrangement 640 may be controlled by positioning and directing/aligning the holding unit 620.

Figure 7:
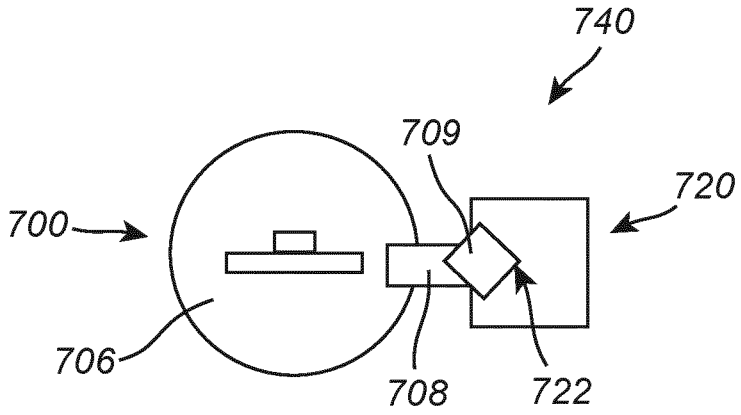
FIG. 7 is a cross-sectional illustration of a LED filament arrangement in accordance with some embodiments.

With reference to FIG. 7, a LED filament 700, holding unit 720 and LED filament arrangement 740 in accordance with some embodiments will be described. FIG. 7 shows a cross-sectional view of the LED filament arrangement 740 comprising the LED filament 700 and the holding unit 720. The LED filament 700 may be equivalent to any of the previously described LED filaments 100-600, except that the alignment member 708 comprises an end portion 709 which is wider than the width of a portion of the alignment member 708 that is adjacent to the encapsulant 706. In other words, the end portion 709 is wider than the width of a portion of the alignment member 708 at a point where the alignment member protrudes from the encapsulant 706 (or filament core).

Specifically, in the embodiment shown in FIG. 7, the end portion 709 may have a square cross section. A side of the square-shaped end portion 709 is angled at 45 degrees relative to the direction of the protrusion of the alignment member 708. The holding portion 722 of the holding unit 720 may then be adapted to mate with the square-shaped end portion 709. In the LED filament arrangement 740, the end portion 709 of the alignment member 708 has been inserted into the holding portion 722 of the holding unit 720. The shape of the end portion may ensure that the holding unit holds the LED filament more securely in place. For example, the shape of the end portion 709 and the corresponding shape of the holding portion 722 may decrease the risk of the alignment member 708 falling out of the holding unit 720.

It will be appreciated that the alignment member and the holding unit may comprise other types of matching interlocking means. For example, the alignment member may comprise a groove, indentation or cut, and the holding unit may comprise a corresponding ridge or edge, or vice versa.

Figure 8:
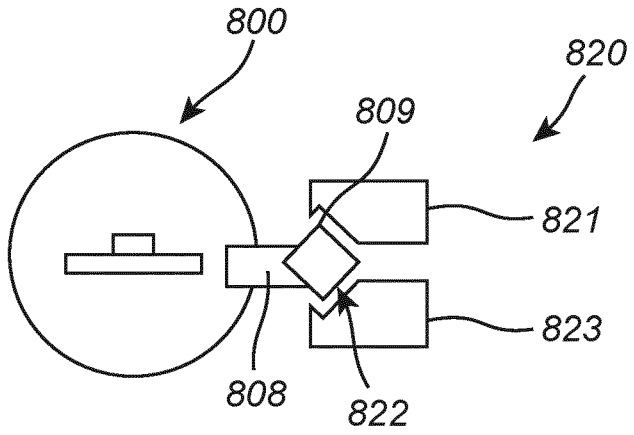
FIG. 8 is a cross-sectional illustration of a LED filament and a holding unit in accordance with some embodiments.

With reference to FIG. 8, a holding unit 820 comprising a clamp will be described, in accordance with some embodiments.

FIG. 8 shows a cross-sectional view of a LED filament 800 and a holding unit 820. The LED filament 800 may be equivalent to the LED filament 700 described with reference to FIG. 7. The holding unit 820 comprises two portions 821, 823, together forming a clamp. Each of the two portions 821, 823 defines a part of the holding portion 822, which is adapted to mate with the end portion 809 of the alignment member 808. FIG. 8 shows the holding unit 820 (clamp) in an open state, i.e. before clamping the alignment member 808. When the clamp is closed, i.e. when the two portions 821, 823 are moved together and arranged in contact with one-another, the alignment member 808, and thus the LED filament 800, is firmly secured in place by the holding unit clamping the end portion 809.

It will be appreciated that the holding unit may comprise further portions or elements which are not presently illustrated. For example, the holding unit may comprise further portions or elements for arranging the LED filament, or for connecting with an arrangement structure.

Figure 9:
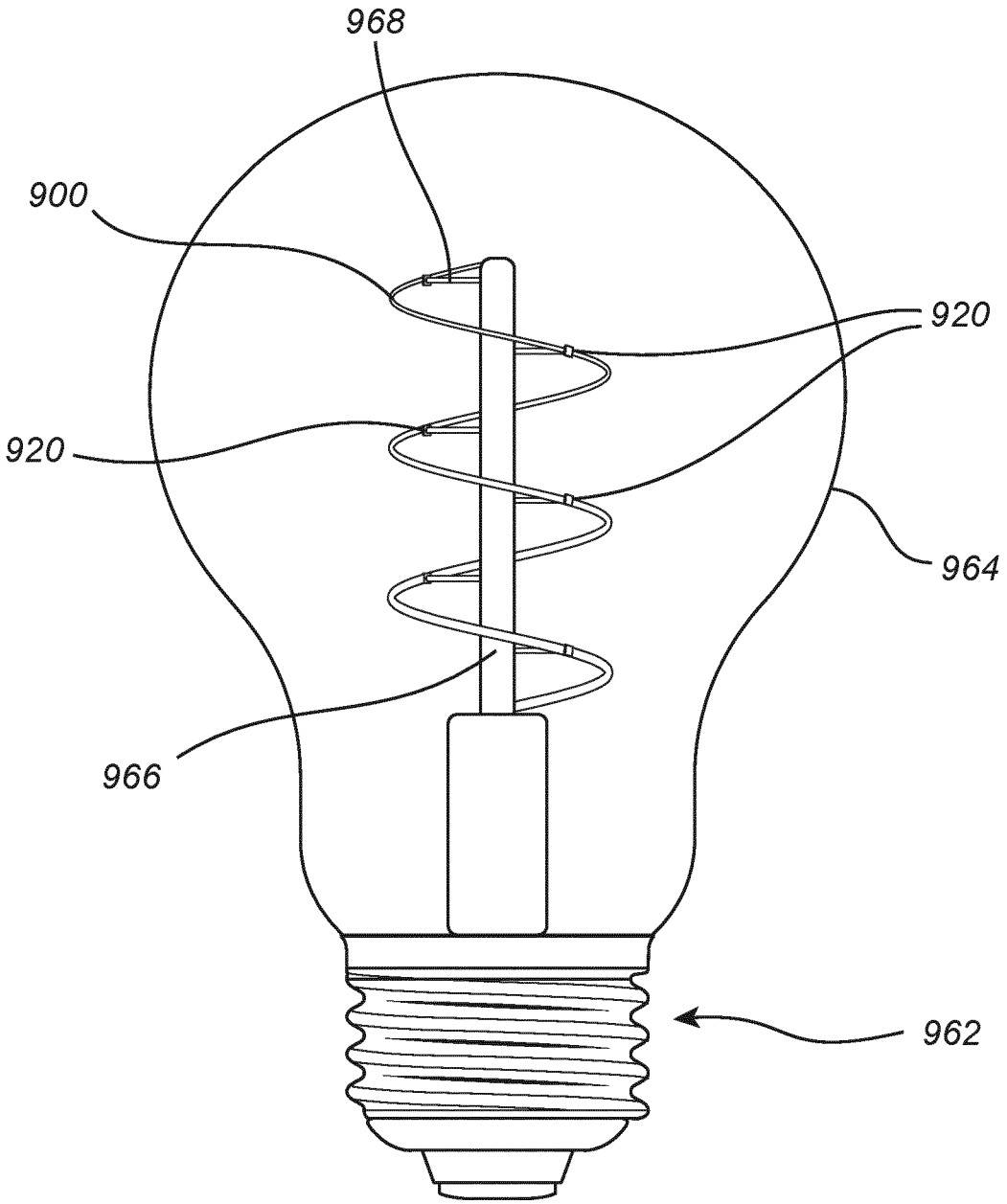
FIG. 9 is a schematic illustration of a lighting device in accordance with some embodiments.

With reference to FIG. 9, a lighting device 960 in accordance with some embodiments will be described. FIG. 9 is a schematic illustration of a lighting device 960. The lighting device comprises a LED filament arrangement including a LED filament 900 and a plurality of holding units 920. The LED filament may be equivalent to any of the LED filaments 100-800 described with reference to any of the preceding embodiments (see the preceding figures). The holding units 920 may be equivalent to the holding units 520 or 620 described with reference to any of the preceding embodiments (see FIGS. 5 and 6).

The lighting device 960 further comprises an at least partially light-transmissive envelope 964 and a base 962 on which the envelope 964 is mounted. The base 962 is adapted to be connected to a socket of a luminaire. Specifically, the base is adapted to be connected to an Edison type socket. However, in other embodiments, the base may be adapted to be connected to other types of luminaire sockets.

The LED filament arrangement is arranged within the envelope 964. The LED filament 900 is arranged in a spiral shape by means of the holding units 920. Within each of the holding units 920, a portion of the LED filament 900 is arranged, for example in a manner such as shown in FIGS. 6 and 6A. Attached to each of the holding units is an arrangement unit 968, which connects the holding units 920 to a LED filament support structure 966. It will be appreciated that in other embodiments, the holding units 920 may comprise arrangement portions such that the LED filament 900 may be arranged within a lighting device without the use of arrangement units 968 and/or support structures 966.

The lighting device 960 may be referred to as a LED filament lamp. The LED filament lamp may be configured to emit LED filament lamp light. LED filament lamp light may comprise LED filament light.

The alignment member (608 in FIG. 6A) provides that the LED filament may be turned/directed such that a desired light-distribution may be obtained. Specifically, if the holding units 920, which have a holding portion (622 in FIG. 6A) arranged to mate with the alignment member, are turned/directed, the LED filament 900 may turn as well. Thus the arrangement of the holding units 920 may be adapted such that the LED filament 900 is turned (aligned/directed) to provide a desired light-distribution. For example, the LED filament 900 may be directed such that the side of the carrier (102 in FIG. 1) on which the LEDs (104 in FIG. 1) are arranged faces the envelope 964. Thus, uniformity of the light-distribution of the LED filament lamp light may be enhanced.

The person skilled in the art realizes that the present invention by no means is limited to the preferred embodiments described above. On the contrary, many modifications and variations are possible within the scope of the appended claims.

Although features and elements are described above in particular combinations, each feature or element can be used alone without the other features and elements or in various combinations with or without other features and elements.

Additionally, variation to the disclosed embodiments can be understood and effected by the skilled person in practicing the claimed invention, from a study of the drawings, the disclosure, and the appended claims. In the claims, the word "comprising" does not exclude other elements, and the indefinite article "a" or "an" does not exclude a plurality. The mere fact that certain features are recited in mutually different dependent claims does not indicate that a combination of these features cannot be used to advantage.

The invention claimed is:

1. A light-emitting diode, LED, filament including an elongated filament core comprising:

a flexible elongated carrier having a first side;

a plurality of LEDs arranged on said first side; and an encapsulant embedding at least said plurality of LEDs;

wherein at least one alignment member protrudes from said filament core, wherein said at least one alignment member is formed by a protrusion of said encapsulant or the entire carrier is embedded in the encapsulant and said at least one alignment member is formed by an alignment element partly inserted into said encapsulant to a specific depth, wherein said alignment member comprises an end portion which is wider than a width of a portion of the alignment member which is adjacent to the filament core, and wherein at least a portion of said filament core has a cylindrical shape, and wherein said alignment member protrudes radially from the cylindrically shaped portion.

2. The LED filament according to claim 1, wherein said at least one alignment member extends continuously along an elongation of the LED filament.

3. The LED filament according to claim 1, wherein said at least one alignment member extends in segments arranged at particular positions along an elongation of the LED filament.

4. The LED filament of claim 3, wherein said segments are arranged at regular intervals along the elongation of the LED filament.

5. The LED filament of claim 1, wherein a length of protrusion of said at least one alignment member from said filament core is in the range 1-10 mm.

6. The LED filament of claim 1, wherein said encapsulation further embeds said first side of the carrier and a second side, opposite to said first side.

7. A LED filament arrangement comprising:

a LED filament according to claim 1, further comprising at least one holding unit comprising a holding portion adapted to mate with said at least one alignment member of the LED filament; and wherein said holding unit is arranged to hold the LED filament by insertion of the alignment member of the LED filament into the holding portion of the holding unit.

8. The LED filament arrangement of claim 7, wherein said at least one holding unit comprises a clamp arranged to clamp said at least one alignment member.

9. The LED filament arrangement of claim 7, wherein said holding unit comprises a cavity in which at least a portion of the LED filament is arranged such that the holding unit surrounds said portion of the LED filament.

10. A lighting device comprising: a LED filament arrangement as defined in claim 7;

an at least partially light-transmissive envelope, at least partially enveloping said LED filament arrangement; and a base on which said envelope is mounted;

wherein a position of the at least one holding unit of the LED filament arrangement determines a position of said LED filament within said envelope.

* * * * *